US007563468B2

(12) United States Patent
Bougoulas et al.

(10) Patent No.: US 7,563,468 B2
(45) Date of Patent: Jul. 21, 2009

(54) CHEWING GUM PACKAGES WITH GUM DISPOSAL ACCOMMODATIONS

(75) Inventors: James A. Bougoulas, Chicago, IL (US); William T. Boyd, Aurora, IL (US); Stanley J. Kopecky, Prospect Heights, IL (US); Barbara L. Admans, Mission Viejo, CA (US); Marco A. Garcia, Mississauga (CA); Shai Altman, Kadima (IL); Nikolas J. Harte, Plymouth (GB)

(73) Assignee: Wm. Wrigley Jr. Company, Chicago, IL (US)

( * ) Notice: Subject to any disclaimer, the term of this patent is extended or adjusted under 35 U.S.C. 154(b) by 750 days.

(21) Appl. No.: 10/936,436

(22) Filed: Sep. 7, 2004

(65) Prior Publication Data

US 2006/0051457 A1 Mar. 9, 2006

(51) Int. Cl.
*B65D 85/60* (2006.01)

(52) U.S. Cl. ..... 426/5; 426/108; 426/112; 206/233; 206/531; 206/38; 206/800

(58) Field of Classification Search ..... 206/531, 206/233, 38, 528, 800; 426/106, 108, 112, 426/115, 122, 123, 3.5; 229/102.5
See application file for complete search history.

(56) References Cited

U.S. PATENT DOCUMENTS

| | | | | | |
|---|---|---|---|---|---|
| 1,143,729 | A | * | 6/1915 | Schmidt | 40/312 |
| 2,007,042 | A | * | 7/1935 | Duckett | 206/233 |
| 2,192,472 | A | * | 3/1940 | Huston | 426/5 |
| 2,210,194 | A | * | 8/1940 | Baldwin | 426/5 |
| 2,210,196 | A | * | 8/1940 | Baldwin | 426/5 |
| 3,150,807 | A | * | 9/1964 | Loughary | 225/47 |
| 3,429,426 | A | * | 2/1969 | Weller et al. | 206/531 |
| 3,743,084 | A | * | 7/1973 | Douglas | 206/532 |
| 3,845,858 | A | * | 11/1974 | Jenkins | 206/233 |
| 3,960,269 | A | * | 6/1976 | Jenkins | 206/233 |
| 4,022,319 | A | * | 5/1977 | Jenkins | 206/233 |
| 4,936,462 | A | * | 6/1990 | Yuen | 206/542 |
| 5,096,058 | A | * | 3/1992 | Juravin et al. | 206/232 |
| 5,133,980 | A | * | 7/1992 | Ream et al. | 426/115 |
| 5,289,917 | A | * | 3/1994 | Chabria | 206/232 |
| 5,725,310 | A | * | 3/1998 | Kruczko | 383/11 |

(Continued)

FOREIGN PATENT DOCUMENTS

CH 649 906 A5 6/1985

(Continued)

OTHER PUBLICATIONS

Kanebo "Mint Flash Sugarless Gum" package, date unknown, but prior to Sep. 7, 2004.

(Continued)

*Primary Examiner*—Drew E Becker
(74) *Attorney, Agent, or Firm*—Brinks Hofer Gilson & Lione; Steven P. Shurtz

(57) ABSTRACT

The present invention provides a chewing gum package made from an outer package containing one or more pieces of chewing gum. The package includes at least one disposal sheet to wrap chewing gum cuds for proper disposal. The presence of the disposal sheet serves as a reminder to the consumer to dispose of chewing gum cuds appropriately.

31 Claims, 3 Drawing Sheets

U.S. PATENT DOCUMENTS

| | | | | | |
|---|---|---|---|---|---|
| 5,971,261 | A | * | 10/1999 | Grunfeld et al. | 229/102 |
| 6,070,719 | A | * | 6/2000 | Pollock | 206/232 |
| 6,520,329 | B1 | | 2/2003 | Fuchs et al. | |
| D479,464 | S | * | 9/2003 | Kopecky | D9/432 |
| 6,644,488 | B1 | * | 11/2003 | Coleman | 220/23.4 |
| 6,830,152 | B2 | * | 12/2004 | Smith | 206/527 |
| 2003/0080021 | A1 | * | 5/2003 | Kopecky | 206/531 |
| 2003/0150766 | A1 | * | 8/2003 | Smith | 206/527 |
| 2004/0173475 | A1 | * | 9/2004 | Shimko | 206/233 |
| 2005/0089605 | A1 | * | 4/2005 | Siethoff et al. | 426/106 |
| 2005/0222849 | A1 | * | 10/2005 | Rasmussen | 705/1 |
| 2007/0048414 | A1 | * | 3/2007 | Glydon | 426/120 |
| 2009/0038964 | A1 | * | 2/2009 | Jacobs | 206/233 |

FOREIGN PATENT DOCUMENTS

| | | | | |
|---|---|---|---|---|
| DE | 299 19 654 | U1 | | 3/2000 |
| EP | 0 481 680 | A1 | | 4/1992 |
| IT | 1340175 | B | | 7/2007 |
| JP | 09 202370 | | | 8/1997 |
| JP | 409202370 | A | * | 8/1997 |
| JP | 09 255035 | | | 9/1997 |
| JP | 2006089054 | A | * | 4/2006 |
| WO | WO 2004/081909 | A | * | 9/2004 |

OTHER PUBLICATIONS

"Lotte Sugarless Fresh Mis__" gum package, date unknown, but prior to Sep. 7, 2004.

Lotte gum bottle with disposal paper, date unknown, but prior to Sep. 7, 2004.

* cited by examiner 90
92
94
96
98

110
112

130
132
134

150
152
154

170
171
172
178

190
192
194
196

CHEWING GUM PACKAGES WITH GUM DISPOSAL ACCOMMODATIONS

BACKGROUND OF THE INVENTION

When chewing gum is chewed, an insoluble portion remains. Due to the typical formulation of chewing gums, this remainder can have an adhesive-like characteristic. Although the used chewing gum cud can be easily disposed of without creating any problems, when improperly disposed of, it can stick to environmental surfaces, creating a nuisance and an unsightly appearance.

In a package of chewing gum sticks or tabs, each stick or tab is individually wrapped. Consumers are expected to retain the wrapper and use it for wrapping the chewing gum cud prior to disposal. However, packages for pellet gums, which have been in use for many years, typically lack such wrapping means for individual pieces.

Hence, there is a perceived need, where the gum is not individually wrapped, for a chewing gum package with disposal accommodations.

SUMMARY OF THE INVENTION

The present invention provides a product and method for disposal of chewing gum after having been chewed where the gum piece is not packaged with an individual wrapper. In a first aspect, the invention is a chewing gum package comprising an outer package; at least one chewing gum piece in the outer package; and at least one disposal sheet, the disposal sheet either being a plurality of disposal sheets not wrapped around the at least one chewing gum piece or at least one sheet configured to be subdivided into multiple disposal sheets.

More preferably, the present invention provides a chewing gum package with disposal sheets removably connected to the outside of the chewing gum package or contained within the package in a form that they can be removed one at a time and used to wrap a chewing gum cud for disposal.

The invention also involves methods of packaging chewing gum and using disposal sheets.

In addition, the present invention provides a reminder to dispose of chewing gum appropriately by the presence of the disposal sheet. When a consumer sees a wrapping means, e.g. tissue or the like, it serves as a visual reminder to wrap the chewing gum cud and dispose of it in a waste receptacle. This may reduce the inappropriate disposal of chewing gum cuds onto other environmental surfaces.

These and other advantages of the invention, as well as the invention itself, will be more easily understood in view of the attached drawings.

BREIF DESCRIPTION OF DRAWINGS

Figure 8:
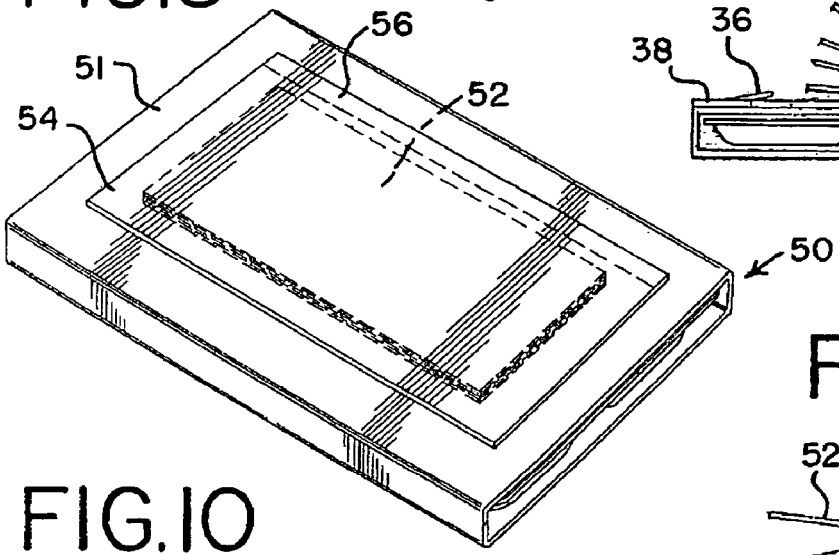

FIG. 8 a perspective view of a third embodiment of the present invention showing a third form of a chewing gum package made from a paper board sleeve housing a blister pack.

Figure 9:
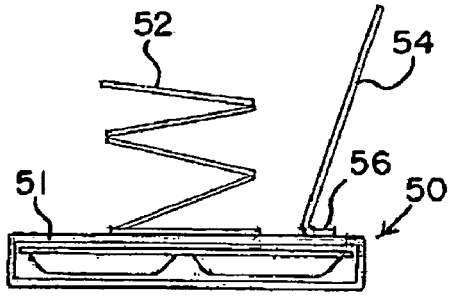

FIG. 9 a side elevational view of the package of FIG. 8.

Figure 10:
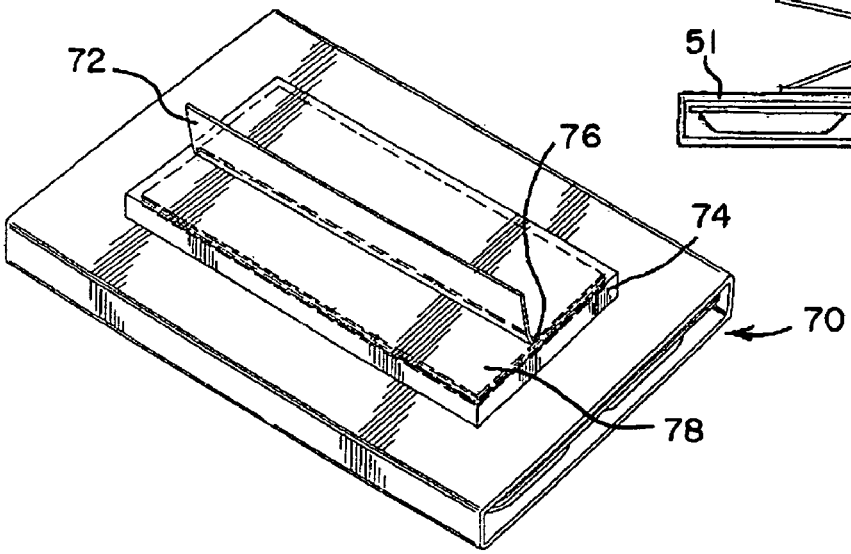

FIG. 10 is a perspective view of a fourth embodiment of the present invention showing a fourth form of a chewing gum package made from a paper board sleeve housing a blister pack.

Figures 11, 12, 13, 14, 15, 16:
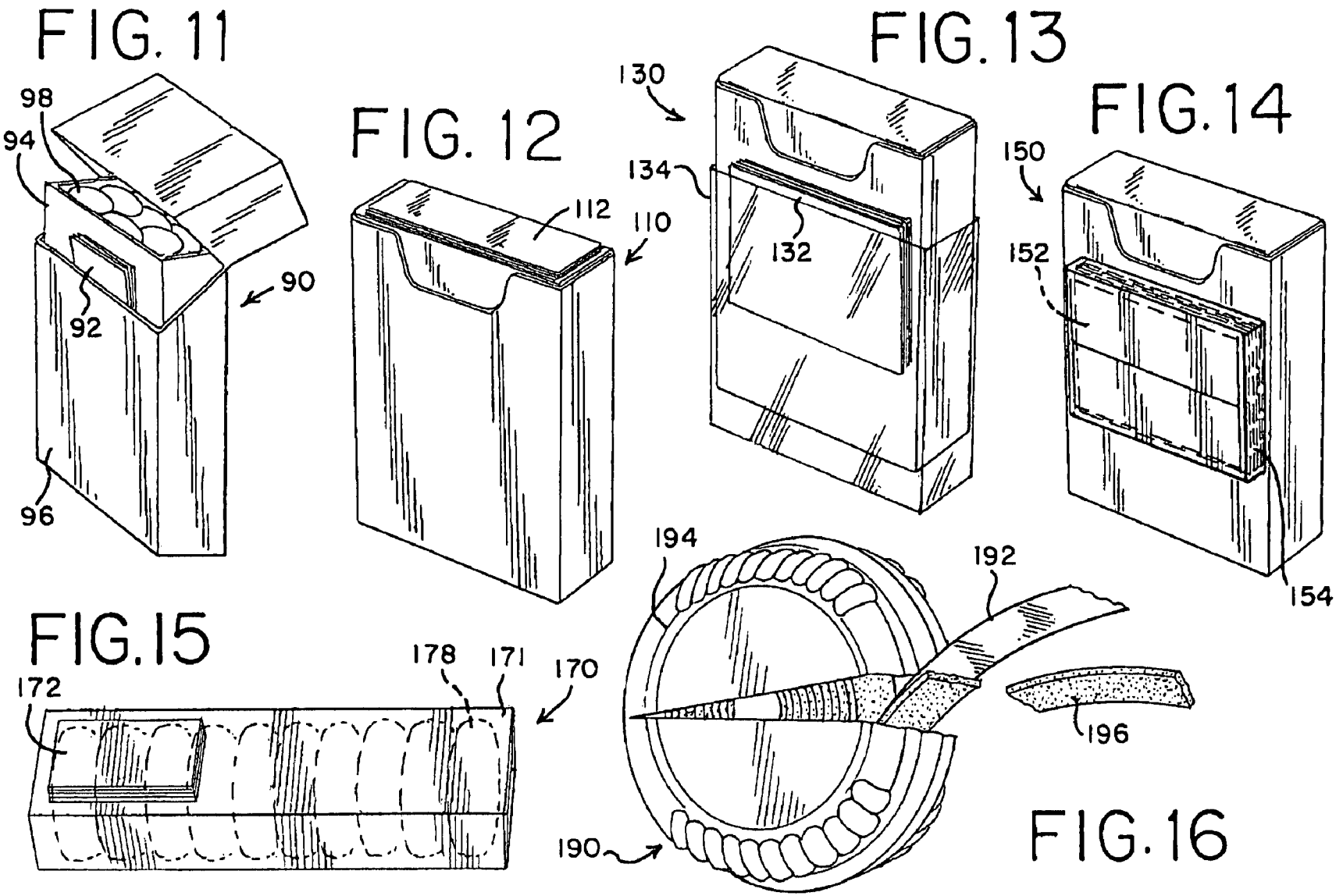

FIG. 11 is a perspective view of a fifth embodiment of the present invention showing a chewing gum package made from a flip-top box.

FIG. 12 is a perspective view of a sixth embodiment of the present invention showing a chewing gum package made from a standard box with a fold-in top flap.

FIG. 13 is a perspective view of a seventh embodiment of the present invention showing a second chewing gum package made from a standard box.

FIG. 14 is a perspective view of an eighth embodiment of the present invention showing a third chewing gum package made from a standard box.

FIG. 15 is a perspective view of a ninth embodiment of the present invention showing a chewing gum package made from a sleeve filled with coated chewing gum pellets.

FIG. 16 is a perspective view of a tenth embodiment of the present invention showing a chewing gum package made from a canister holding a roll of chewing gum.

DETAILED DESCRIPTION OF THE DRAWINGS AND PREFERRED EMBODIMENTS

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous. The term "chewing gum" as used herein also includes bubble gum and the like.

The present invention provides a novel chewing gum package. Specifically, the present invention provides an outer package containing at least one chewing gum piece in the outer package; and at least one disposal sheet. The at least one disposal sheet may be a plurality of sheets being together and not wrapped around the chewing gum piece, or a large disposal sheet intended to be subdivided before being used.

The chewing gum package may be of a variety of different forms, including a blister pack, an over wrapped package, a wrapped pellet package, a rolled gum canister, a tin box, etc. Chewing gum packages may be made from a variety of different materials. They can be made from rigid plastic, flexible plastic, tin or other metal, paper, paper-plastic composite, corrugated paper, paperboard and the like. Paper board may be of 12-30 SBS (solid bleach sulphate), preferably 14-18 SBS.

The outer package will typically either contain a plurality of individual pieces or chewing gum, such as a plurality of coated chewing gum pellets, or a piece of chewing gum that is configured to be subdivided before being chewed, such as a long, thin rolled up gum product. A widely known product of this latter type is sold under the trademark BUBBLE TAPE®.

The at least one disposal sheet is preferably either removably connected to the outside of said package or contained within the package.

Typical chewing gum packages for pellet-type gum utilizing the present invention are shown in FIGS. 1-16. FIGS. 1-3 and 6-10 show embodiments of chewing gum packages for flat pellet gum, often described as "blister packs", because the gum pellets are provided in individual blisters contained within an outer sleeve. FIG. 11 shows an embodiment of a flip-top box package. FIGS. 12-14 show embodiments of a standard box with a fold-in top flap. FIG. 15 shows a sleeve filled with coated chewing gum pellets. FIG. 16 shows a canister with a roll of gum inside. Each of these common packages has been modified in accordance with the present invention to include at least on disposal sheet.

Figures 1, 2, 3, 4, 5:
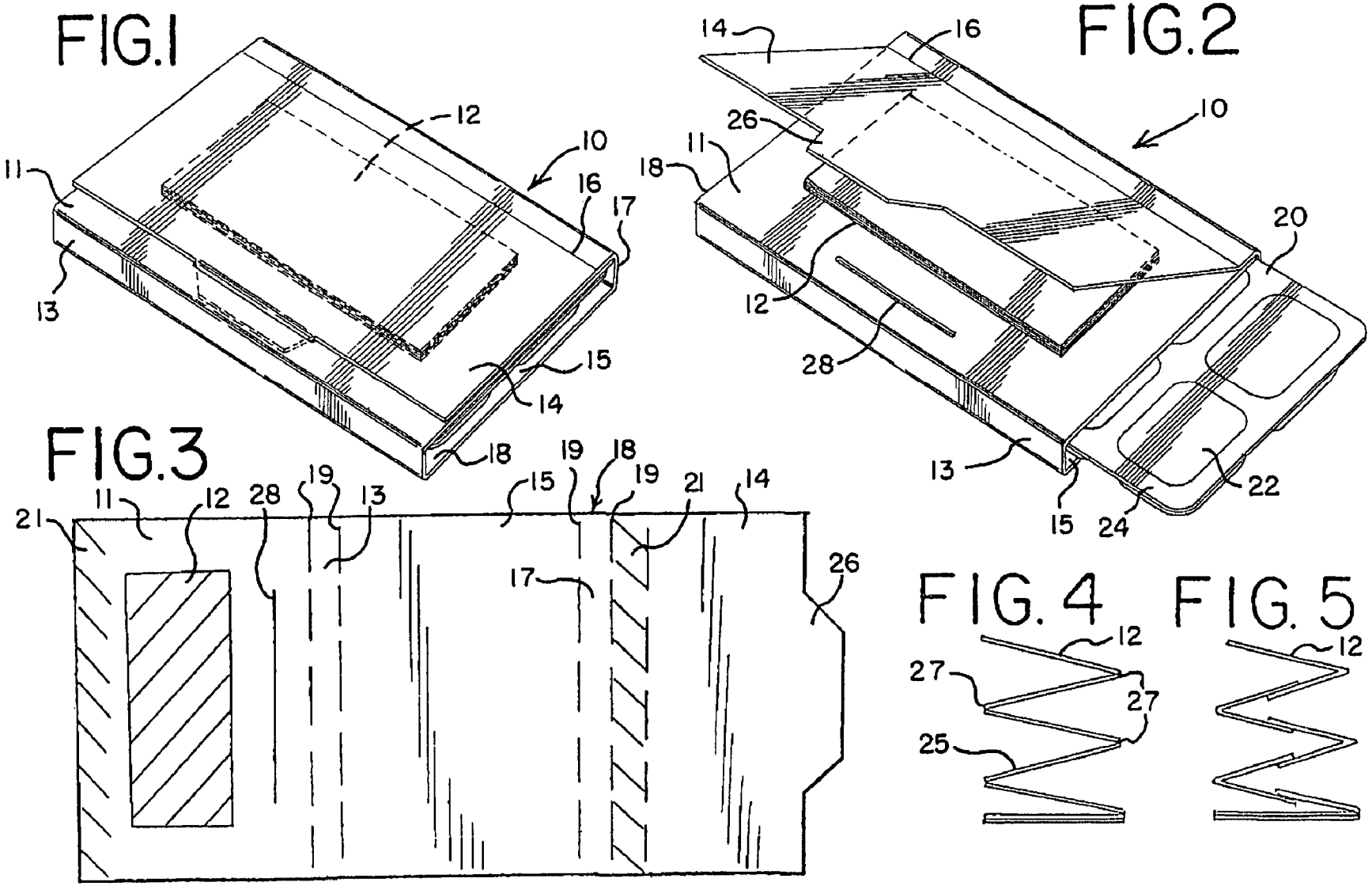
FIG. 1 is a perspective view of a first embodiment of the present invention showing a chewing gum package made from a paper board sleeve housing a blister pack.
FIG. 2 is a perspective view of the package of FIG. 2 showing a fifth panel of the sleeve opened to expose the disposal sheets.
FIG. 3 is a plan view of a blank used to make the sleeve of the package of FIGS. 1 and 2.
FIG. 4 is a schematic representation of a first embodiment of the disposal sheets used in the package of FIGS. 1-3.
FIG. 5 is a schematic representation of a second embodiment of the disposal sheets used in the package of FIGS. 1-3.

FIGS. 1 and 2 show a first chewing gum package 10 of the present invention. Package 10 is a blister pack with a stack of disposal sheets 12 on the outside of the package, covered by a flap 14 on a fifth panel. The fifth panel is part of the sleeve 18 around the blister tray 20 which houses the chewing gum pieces in individual blisters 22. The flap 14 may be on any side of the package and of any shape, such as a rectangle as shown, or a circle, square, triangle or any other shape. The flap 14 may be of any size appropriate to fit on the chewing gum package.

The blister tray 20 is made of plastic material such as PET (polyethylene terephthalate), saran, polypropylene and the like. The blisters 22 in the selected material are thermoformed by heating the material and a vacuum apparatus creates a blister pocket and the material is then cooled and set.

The thermoformed blister 22 contains one or sometimes more chewing gum pellets in each blister. One side of the blister has the openings of the blister and that is covered with a rupturable sealant sheet material 24 to provide a barrier to the environment and to preserve freshness of the chewing gum pellets. The material used for the cover sheet of the blisters may be aluminum, metallized film, polyethylene, polycoated paperboard or any other material providing adequate barrier. In use, pellets are pushed from the blister side, typically by a consumer's thumb, through the sealant sheet to dispense for use.

FIG. 3 depicts a blank from which the sleeve 18 is constructed. The first panel 11 has the stack of disposal sheets secured to it, and makes up what would normally be considered the front of the sleeve. The second panel 13 and fourth panel 17 make up the sides of the sleeve 18. The third panel 15 makes up the bottom of the sleeve. Fold lines 19 separate the various panels. Glue areas 21 show where the first and fifth panels are glued together at their overlap when the sleeve 18 is folded. The glue area and the last fold line 19 create a hinge 16 from which the flap 14 portion of fifth panel extends. The sleeve has two open ends, as seen in FIGS. 1 and 2, when made from the blank of FIG. 3. The sleeve 18 may be made of any material known in the art. Typically the sleeve 18 is made of material selected from the group consisting of paper, paperboard, corrugated paper, paper-plastic composite, polycoated paperboard, plastic, rigid plastic, metal, tin and combinations thereof.

The opening/closure of the flap 14 may be a tuck flap 26 that fits into a slot 28 on the first panel 11, as shown. However, in other embodiments the flap may be kept closed by means of a tab-lock feature, hook and loop fasteners, a snap, a button, a zipper, overlapping flaps, adhesive, a tuck flap, a loop and button, and combinations thereof, or any other means.

Figure 6:
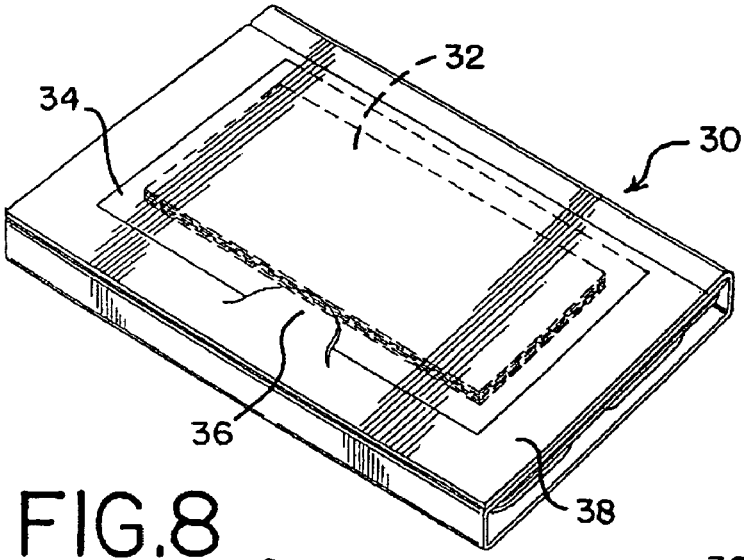
FIG. 6 is a perspective view of a second embodiment of the present invention showing another form of a chewing gum package made from a paper board sleeve housing a blister pack.
Figure 7:
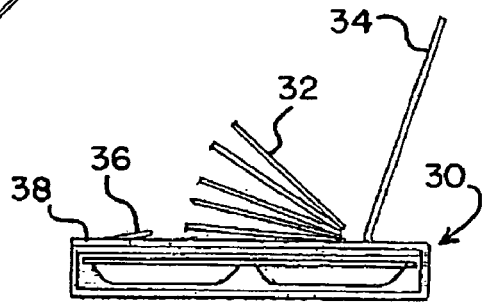
FIG. 7 is a side elevational view of the package of FIG. 6.

FIGS. 6 and 7 show another embodiment of a blister pack chewing gum package 30. This embodiment uses a tuck flap to hold a flap 34 closed over the stack of disposal sheets 32. A tab 36 formed in the fifth panel 38 is used to hold the flap 34 closed.

Disposal sheets 12 are preferably attached to chewing gum packages with a low tack adhesive, but may be attached by other attachment means such as fasteners, tab-lock features and slots. Disposal sheets may also be loosely contained between the first and fifth panels of a chewing gum package with no attachment means.

Disposal sheets 12 may be provided in a variety of presentations. They may be a plurality of disposal sheets, or comprise a continuous sheet configured so as to provide a plurality of disposal sheets, such as by being intermittently folded, preferably with perforations, to define separate disposal sheets. One embodiment is a sheet 25 which is intermittently folded into segments, as shown in FIG. 4, preferably with perforations 27 at the folds to help separate the sheets. Disposal sheets 12 may also be stacked and interleaved as in FIG. 5. The disposal sheets of the present invention may also be adhesively connected respositionable sheets, as in the commercially available POST-IT® notes from Minnesota Mining and Manufacturing, St. Paul, Minn. This design is used in the stack of disposal sheets 32 shown in FIG. 7. Disposal sheets may also be loose sheets not attached to the package or each other, and compactly contained in a sleeve, pouch or a depression behind a fifth panel of a chewing gum package.

The disposal sheets 12 of the present invention may be of any flexible material which is effective to wrap and contain a chewing gum cud. Disposal sheets may be made of paper, wax, aluminum foil, tissue, cellophane, woven cloth, nonwoven cloth, foil-tissue laminate, flexible plastic, soft plastic and the like.

It is preferable to have a number of disposal sheets, or segments of a single perforated sheet, approximately equal to the number of servings of chewing in the chewing gum package. Where the chewing gum is provided in large pellet form, each pellet being considered one serving, the number of disposal sheets will be approximately equal to the number of pellets of chewing gum contained in the package. It is also preferable for the disposal sheet to be contained in a compact manner.

FIGS. 8 and 9 show another embodiment of a blister pack package of chewing gum 50. In this package, the flap 54 is added to the package as a separate item, rather than being part of a fifth panel on the blank from which the sleeve is made. The flap 54 is secured to the first panel 51 along a glue area 56, and extends over the stack of disposal sheets 52, but is not as wide as the panels. As best seen in FIG. 9, the disposal sheets 52 may be provided by a folded sheet with perforations, as in FIG. 4.

FIG. 10 shows a blister pack chewing gum package 70 in which the disposal sheets 72 are contained within a dispenser 74 attached to the exterior of the outer package. The dispenser 74 has a slit 76 on a surface 78 opposite to the attachment. The disposal sheets 72 are connected to one another such that pulling one disposal sheet completely from the package pulls the succeeding disposal sheet partially through the slit, leaving it in the position shown in FIG. 10.

In other embodiments, the chewing gum package is a flip top box, as shown in FIG. 11. The flip top box 90 may contain a plurality of coated chewing gum pellets 98, loosely stacked or otherwise contained within the box. When made according to the present invention, such a box may have an inner sleeve 94 holding the pellets 98. The disposal sheets 92 are preferably placed between the inner sleeve 94 and the front panel 96 of the outer box. In this embodiment, it is preferred that disposal sheets are loose sheets not attached to the package or each other. The disposal sheets may alternatively be compactly contained in a pouch inside the box 90, with or without an inner sleeve 94.

In yet another embodiment, the chewing gum package 110 is a standard box with a fold-in top flap, as shown in FIG. 12. The package 110 will also preferably contain coated chewing gum pellets. The disposal sheets 112 are adhesively connected to the exterior surface of the box. The sheets may be connected to the top (as shown) or any other side of the box. It is preferred that in this type of embodiment, the disposal sheets are adhesively connected repositionable sheets.

FIG. 13 shows a standard box 130 with a fold-in top flap with the disposal sheets 132 adhered to the front panel of the box. Many chewing gum packages have a clear ruptuarable sealant sheet used as an over wrap film 134 that is sealed around the outer package to preserve freshness. Usually the over wrap is removed and discarded when the package is first opened. The over warp may be designed to come apart so that only part of it is removed and the remainder stays on the package and covers the disposal sheets. The over wrap can then be slid partly off the package, as shown in FIG. 13, to allow access to the disposal sheets 132, and then repositioned over the disposal sheets when the opened package is placed in a consumer's pocket or purse.

FIG. 14 shows a standard box 150 with a fold-in top flap with the disposal sheets 152 contained within a dispenser 154, much like the embodiment of FIG. 10. Of course it should be understood that the method of presenting the disposal sheets used with the embodiments of FIGS. 12-14 may also be used with the flip top box 90 of FIG. 11, as well as the blister pack of FIGS. 1-3.

FIG. 15 shows the present invention applied to a chewing gum package 170 comprising an outer sleeve 171 filled with coated chewing gum pellets 178. In this type of package, the outer sleeve is typically torn off as pellets are consumed. Hence, the disposal sheets 172 are preferably located towards one end of the package. The consumer may then tear off portions of the package at the other end without disturbing the disposal sheets. The disposal sheets may be covered by an over wrap, as in the package 130 shown in FIG. 13, or protected in some other fashion.

FIG. 16 shows a chewing gum package 190 in the form of a canister 194. The canister holds a roll of chewing gum, preferably bubble gum 196. In this package the disposal sheet comprises a long, thin, continuous sheet 192, rolled up with the gum 196. When a consumer wants a piece of gum, the canister 194 is opened and a length of gum 196 and disposal sheet 192 are both pulled from the canister. The gum and disposal sheet are separated, and a serving of gum is torn off of the roll, preferably leaving the disposal sheet 192 intact, as shown. When the consumer is done chewing the serving of gum, the consumer tears off the extending portion of the disposal sheet to obtain a sheet to wrap the cud in. Of course, rather than being rolled up with the gum, a stack of disposal sheets could be adhered to the outer surface of canister 194.

From the forgoing it will be seen that the invention also includes a method of packaging chewing gum with disposal sheets. First a chewing gum outer package is formed. Second, one or more pieces of chewing gum and at least one disposal sheet is provided. The one or more pieces of chewing gum are not individually wrapped, but placed in the outer package in an unwrapped form. The one or more disposal sheets are also placed in or on the outer package so as to be available for a person who chews some of the gum to remove one of the disposal sheets (when a plurality of disposal sheets are provided) or a portion of a disposal sheet, to wrap the cud remaining from chewing the gum.

The invention also encompasses a method of using a disposal sheet to dispose of a chewing gum cud. The consumer removes a serving of chewing gum from a chewing gum package. The serving is not individually wrapped. The consumer chews the chewing gum serving until a cud remains. The consumer pulls a disposal sheet from a plurality of disposal sheets provided with the package, or a piece of a larger disposal sheet configured to be subdivided into individual disposal sheets, and places the cud in the disposal sheet before discarding the cud.

The chewing gum package may also have a written reminder to dispose of chewing gum cuds printed, painted, imprinted, stamped, marked, pressed or embossed on the package. The written reminder may be located on the box, disposal sheet, blister pack, over wrap or any other location or combination of locations on the chewing gum package. In that regard, the invention also encompasses a method of providing a reminder to a consumer to dispose of a chewing gum cud appropriately, by providing the chewing gum package with at least one disposal sheet separate from and not wrapped around the chewing gum. In this manner, the consumer realizes that the disposal sheet is specifically for the purpose of disposing of the chewing gum cud.

The present invention meets a long-felt need in providing accommodations for cud disposal with chewing gum packages that have not heretofore included any type of disposal sheet. This makes it convenient for the consumer to properly dispose of the chewing gum cud.

It should be understood that various changes and modifications to the presently preferred embodiments described herein will be apparent to those skilled in the art. For example, the different methods of attaching or including the disposal sheets used on one embodiment, as well as the format of the disposal sheets themselves, may be used on the other package types described herein, as well as other packages. Such changes and modifications can be made without departing from the spirit and scope of the present invention and without diminishing its intended advantages. It is therefore intended that such changes and modifications be covered by the appended claims.

The invention claimed is:

1. A chewing gum package comprising:

a) a blister package and an outer sleeve having first, second, third and fourth side panels folded and secured together to make the sleeve, and having two open ends, the outer sleeve further comprising a fifth panel overlying the first side panel, the fifth panel commencing at a fold in the sleeve between the fourth and fifth side panels, that fold being located at a junction of the first and fourth side panels, the first and fifth side panels being glued together in a glue area that borders the junction of the first and fourth side panels, the fifth panel extending beyond the glue area and ending in a flap;

b) a plurality of chewing gum pieces in said blister package; and c) at least one disposal sheet located between the flap and the first side panel and configured to be used to dispose of a cud remaining from chewing one of said gum pieces.

2. The package of claim 1 wherein said plurality of chewing gum pieces comprises a plurality of chewing gum pellets.

3. The package of claim 2 wherein said chewing gum pellets are coated.

4. The package of claim 1 wherein said blister package comprises a blister tray covered by a rupturable sealant sheet.

5. The package of claim 1 wherein said at least one disposal sheet comprises a material selected from the group consisting of paper, wax, aluminum foil, tissue, cellophane, woven cloth, non-woven cloth, foil-tissue laminate, flexible plastic, soft plastic and combinations thereof.

6. The package of claim 1 wherein said outer sleeve is made of a material selected from the group consisting of paper, paperboard, corrugated paper, paper-plastic composite, poly-coated paperboard, plastic and combinations thereof.

7. The package of claim 1 wherein the number of said disposal sheets is at least equal to the number of pieces of chewing gum contained in said package.

8. The package of claim 2 wherein the number of said disposal sheets is approximately equal to the number of said chewing gum pellets contained in said package.

9. The package of claim 1 wherein said number of disposal sheets is approximately equal to the number of servings of chewing gum contained in said package.

10. The package of claim 1 wherein said flap is the same width as the first side panel.

11. The package of claim 1 wherein said flap of said outer sleeve is not as wide as the first side panel.

12. The package of claim 1 wherein said flap is closed with a closure selected from the group consisting of a tab lock, tuck flap, zipper, snap, button, slot, loop and button, overlapping flaps, and combinations thereof.

13. The package of claim 1 wherein said at least one disposal sheet comprises a continuous sheet with perforations to define separate disposal sheets.

14. The package of claim 1 wherein said at least one disposal sheet comprises a plurality of interleaved disposal sheets.

15. The package of claim 1 wherein said at least one disposal sheet comprises a plurality of disposal sheets adhesively connected to one another.

16. The package of claim 1 wherein said at least one disposal sheet comprises a plurality of loosely stacked disposal sheets.

17. The package of claim 1 wherein said at least one disposal sheet comprises a plurality of disposal sheets not adhesively connected to each other or the package.

18. The package of claim 1 wherein said at least one disposal sheet comprises a plurality of disposal sheets contained within a dispenser attached to the first side panel, the dispenser having a slit on a surface opposite to the attachment.

19. The package of claim 18 wherein said disposal sheets are connected to one another such that pulling one disposal sheet completely from the package pulls the succeeding disposal sheet partially through the slit.

20. The package of claim 1 wherein said at least one disposal sheet comprises a plurality of disposal sheets contained within a pouch.

21. The package of claim 1 wherein said at least one disposal sheet comprises a plurality of adhesively connected repositionable sheets.

22. A method of using a disposal sheet to dispose of a chewing gum cud comprising:

a) removing a piece of chewing gum from a chewing gum package comprising a blister package and an outer sleeve made from first, second, third and fourth side panels folded and secured together to make the sleeve, and having two open ends, the outer sleeve further comprising a fifth panel overlying the first side panel the fifth panel commencing at a fold in the sleeve between the fourth and fifth side panels, that fold being located at a junction of the first and fourth side panels the first and fifth side panels being glued together in a glue area that borders the junction of the first and fourth side panels, the fifth panel extending beyond the glue area and ending in a flap, the piece not being individually wrapped;

b) chewing the chewing gum piece until a cud remains;

c) pulling a disposal sheet from a plurality of disposal sheets provided between the flap and the first side panel; and d) placing the cud in the disposal sheet before discarding the cud.

23. A method of packaging chewing gum with one or more disposal sheets comprising:

a) forming an outer sleeve made from first, second, third and fourth side panels folded and secured together to make the sleeve, and having two open ends, the outer sleeve further comprising a fifth panel overlying the first side panel, the fifth panel commencing at a fold in the sleeve between the fourth and fifth side panels, that fold being located at a junction of the first and fourth side panels, the first and fifth side panels being glued together in a glue area that borders the junction of the first and fourth side panels, the fifth panel extending beyond the glue area and ending in a flap;

b) providing at least one disposal sheet;

c) providing one or more pieces of chewing gum;

d) placing the one or more pieces of chewing gum in a blister package, the one or more pieces not being individually wrapped, and placing the blister package in the outer sleeve; and e) placing the at least one disposal sheet between the flap and the first side panel so as to be available for a person who chews some of the gum to remove one of the disposal sheets or a portion of a disposal sheet to wrap the cud remaining from chewing the gum.

24. The method of claim 23 wherein the at least one disposal sheet is secured to the first side panel before the outer sleeve is formed, and the flap is placed over the at least one disposal sheet as part of forming the outer sleeve.

25. The package of claim 1 wherein the at least one disposal sheet comprises a plurality of disposal sheets not wrapped around said at least one chewing gum piece.

26. The package of claim 1 wherein the at least one disposal sheet comprises a sheet configured to be subdivided into multiple disposal sheets.

27. The package of claim 26 wherein said sheet configured to be subdivided into multiple disposal sheets is intermittently folded.

28. The package of claim 1 wherein said at least one disposal sheet comprises a material selected from the group consisting of paper and tissue.

29. The package of claim 1 wherein said outer sleeve is made of a material selected from the group consisting of paper and paperboard.

30. The package of claim 1 wherein said flap is closed with a tuck flap.

31. The package of claim 1 wherein all five panels of the outer sleeve are formed from a single package blank.

* * * * *

UNITED STATES PATENT AND TRADEMARK OFFICE

CERTIFICATE OF CORRECTION

PATENT NO. : 7,563,468 B2
APPLICATION NO. : 10/936436
DATED : July 21, 2009
INVENTOR(S) : James A. Bougoulas et al.

It is certified that error appears in the above-identified patent and that said Letters Patent is hereby corrected as shown below:

In the Claims

In column 8, claim 22, line 2, immediately after "fourth side panels" insert --,--.

Signed and Sealed this
Fifth Day of April, 2011

David J. Kappos

David J. Kappos
*Director of the United States Patent and Trademark Office*